US006470898B1

(12) United States Patent
Kamo

(10) Patent No.: US 6,470,898 B1
(45) Date of Patent: Oct. 29, 2002

(54) PAPER STOCK CLEANING APPARATUS

(75) Inventor: Eiichi Kamo, Shizuoka-ken (JP)

(73) Assignee: Sakee Kohki Co., Ltd., Shizuoka-ken (JP)

( * ) Notice: Subject to any disclaimer, the term of this patent is extended or adjusted under 35 U.S.C. 154(b) by 113 days.

(21) Appl. No.: 09/709,278

(22) Filed: Nov. 13, 2000

(30) Foreign Application Priority Data

Dec. 14, 1999 (JP) ..... 11-355075

(51) Int. Cl.[7] ..... B08B 3/06
(52) U.S. Cl. ..... 134/79; 68/143; 134/159
(58) Field of Search ..... 134/61, 65, 79, 134/132, 159; 68/143

(56) References Cited

U.S. PATENT DOCUMENTS

| | | | | |
|---|---|---|---|---|
| 1,435,285 A | * | 11/1922 | Foster et al. | 134/65 |
| 2,337,137 A | * | 12/1943 | Thompson et al. | 68/144 X |
| 3,727,621 A | * | 4/1973 | Morton | 134/65 X |
| 3,995,458 A | * | 12/1976 | Grunewald et al. | 68/143 X |
| 4,472,272 A | * | 9/1984 | Capannoli | 134/132 X |
| 6,076,379 A | * | 6/2000 | Grandpierre | 68/143 X |

FOREIGN PATENT DOCUMENTS

| | | | | |
|---|---|---|---|---|
| DE | 2156205 | * | 5/1973 | 68/143 |
| EP | 0115456 | * | 8/1984 | 134/132 |
| GB | 1035852 | * | 7/1966 | 134/65 |
| JP | 2709300 | | 10/1997 | |
| SU | 1688829 | * | 11/1991 | 134/79 |

* cited by examiner

*Primary Examiner*—Philip R. Coe
(74) *Attorney, Agent, or Firm*—Wenderoth, Lind & Ponack, L.L.P.

(57) ABSTRACT

Baffle plates 9 extending in a peripheral direction along an internal surface of an air-permeable and water-permeable drum 1 are spacedly arranged in an axial direction, and paper stock cleaning zones 10 are formed between the every adjacent pair of baffle plates 9. Raking plates 12 for raking up paper stock liquid in the cleaning zones 10 in a direction of rotation of the drum are spacedly arranged in the peripheral direction between the adjacent baffle plates 9. The raking plates 12 are allowed to project from internal edges of the baffle plates 9. The paper stock moves, zone by zone, through the cleaning zones 10 formed between the baffle plates 9 and reaches a paper stock outlet port 5. The paper stock, when in the paper stock cleaning zones 10, is raked up in the peripheral direction by the raking plates 12 in accordance with rotation of the air-permeable and water-permeable drum 1 and falls by force of gravity, repeatedly. Finally, clean washed paper stock can be obtained at the paper stock outlet port 5.

6 Claims, 9 Drawing Sheets

PAPER STOCK CLEANING APPARATUS

BACKGROUND OF THE INVENTION

1. Field of the Invention

This invention relates to an improvement of a rotary drum type paper stock cleaning apparatus provided by Japanese Patent No. 2709300.

2. Related Art

A paper stock cleaning apparatus disclosed in Japanese Patent No. 2709300 comprises a rotatably horizontally disposed air-permeable and water-permeable drum, one end of which is provided with a paper stock inlet port and the other end of which is provided with a paper stock outlet port, a cleaning water supply device for supplying cleaning water to a paper stock within the air-permeable and water-permeable drum, a plurality of baffle plates extending in a peripheral direction along an internal peripheral surface of the air-permeable and water-permeable drum and spacedly arranged in an axial direction, and a plurality of paper stock cleaning zones divided in the axial direction by the baffle plates and being formed between the baffle plates.

A plurality of raking plates are spacedly arranged in the peripheral direction between adjacent baffle plates and adapted to rake the paper stock liquid in the paper stock cleaning zones in a direction of rotation of the drum, and a paper stock flow-through space for allowing the paper stock to flow therethrough in the peripheral direction is formed between an external edge of the inclination raking plates and an internal peripheral surface of the air-permeable and water-permeable drum. The paper stock loaded through the paper stock inlet port is allowed to move, zone by zone, through the paper stock cleaning zones formed between the baffle plates and brought to the paper stock outlet port, and the paper stock, when in the paper stock cleaning zones between the baffle plates, is raked up in the peripheral direction by the raking plates in accordance with rotation of the air-permeable and water-permeable drum, falls by force of gravity, and back flows through the paper stock flow-through space, repeatedly.

The paper stock loaded through one end of the air-permeable and water-permeable drum, as in the above related art, is raked up in the peripheral direction by the raking plates and falls repeatedly in the paper stock cleaning zones, and finally brought to the paper stock outlet port from the paper stock inlet port by moving, zone by zone, through the paper stock cleaning zones. During the above-mentioned procedure, satisfactory agitation and dispersion of the paper stock are enhanced and filtrate is discharged through a peripheral wall of the drum for the paper stock zones of each stage divided by the baffle plates, and effective substitution cleaning is carried out. A cleanly washed paper stock is obtained in the paper stock cleaning zone of the final stage and discharged.

The important feature of the above paper stock cleaning apparatus resides in that the paper stock cleaning zones are formed and the raking plates are provided to the respective cleaning zones so that the paper stock in the cleaning zones is raked up by the raking plates and falls, repeatedly, thereby enhancing filtration and dehydration in each cleaning zone, so that the cleaning effect is remarkably improved.

SUMMARY OF THE INVENTION

It is, therefore, an object of the present invention to provide a paper stock cleaning apparatus in which the paper stock cleaning zones and the raking plates provided to the respective cleaning zones are synergistically increased in function and the effect of cleaning of the paper stock is enhanced significantly.

To achieve the above object, a paper stock cleaning apparatus according to the present invention comprises, as in the above-mentioned related art, a rotatably horizontally disposed air-permeable and water-permeable drum, one end of which is provided with a paper stock inlet port and the other end of which is provided with a paper stock outlet port, a cleaning water supply device for supplying a cleaning water to the paper stock in the air-permeable and water-permeable drum, the paper stock being agitated while having cleaning water applied thereto during the time the paper stock travels from the paper stock inlet port to the paper stock outlet port, a filtrate (substitution cleaning water) being discharged downward of the drum.

The paper stock cleaning apparatus further comprises, as in the above-mentioned related art, a plurality of baffle plates that extend in a peripheral direction along an internal surface of the air-permeable and water-permeable drum and that are spacedly arranged in an axial direction, paper stock cleaning zones divided by the baffle plates in the axial direction are formed between every adjacent pair of baffle plates, and raking plates for raking up paper stock liquid in the cleaning zones in the peripheral direction are spacedly arranged in the peripheral direction between the adjacent baffle plates.

All or a part of the raking plates in the paper stock cleaning zones are disposed in inclined postures with respect to the axis and all or a part of the raking plates are allowed to project inwardly beyond internal edges of the baffle plates, so that even a part of the paper stock that overflows to the next zone by overriding the baffle plates are raked up and then fall, thereby enhancing the cleaning effect.

Preferably, the projecting portions of the raking plates are inclined so as to form a relief angle with respect to the direction of rotation of the air-permeable and water-permeable drum. Owing to this arrangement, the falling of the paper stock as a result of raking up of the paper stock is performed smoothly.

Moreover, the inclined raking plates are oriented with a downward gradient towards the paper stock outlet port so that a part of the paper stock raked up by the inclined raking plates flows to the paper stock cleaning zone adjacent to the paper stock outlet port through the angle at which the raking plates are inclined. Owing to this arrangement, the flowing of the paper stock is enhanced between the paper stock cleaning zones.

A paper stock flow-through space for allowing the paper stock to flow therethrough in the peripheral direction is formed between an external edge of the raking plates and an internal peripheral surface of the air-permeable and water-permeable drum, and the external edge of each of the raking plates is formed in a curved plane generally in harmony (complementary) with that of the internal peripheral surface of the air-permeable and water-permeable drum, such that a space between the external edges of the inclination raking plates and the curved plane of the internal peripheral surface of the air-permeable and water-permeable drum is generally uniform over an entire length of each raking plate. Owing to this arrangement, the back-flow of the paper stock is uniformly performed.

Of course, as in the above-mentioned related art, the paper stock flow-through space may be formed between the external edges of the raking plates other than the inclined raking plates and the internal peripheral surface of the air-permeable and water-permeable drum.

Accordingly, the paper stock, in the cleaning zones between the baffle plates, is raked up in the peripheral direction by the baffle plates and falls by force of gravity, repeatedly. In this manner, dispersion and cleaning of the paper stock are remarkably enhanced.

DETAILED DESCRIPTION OF THE INVENTION

Figure 1:
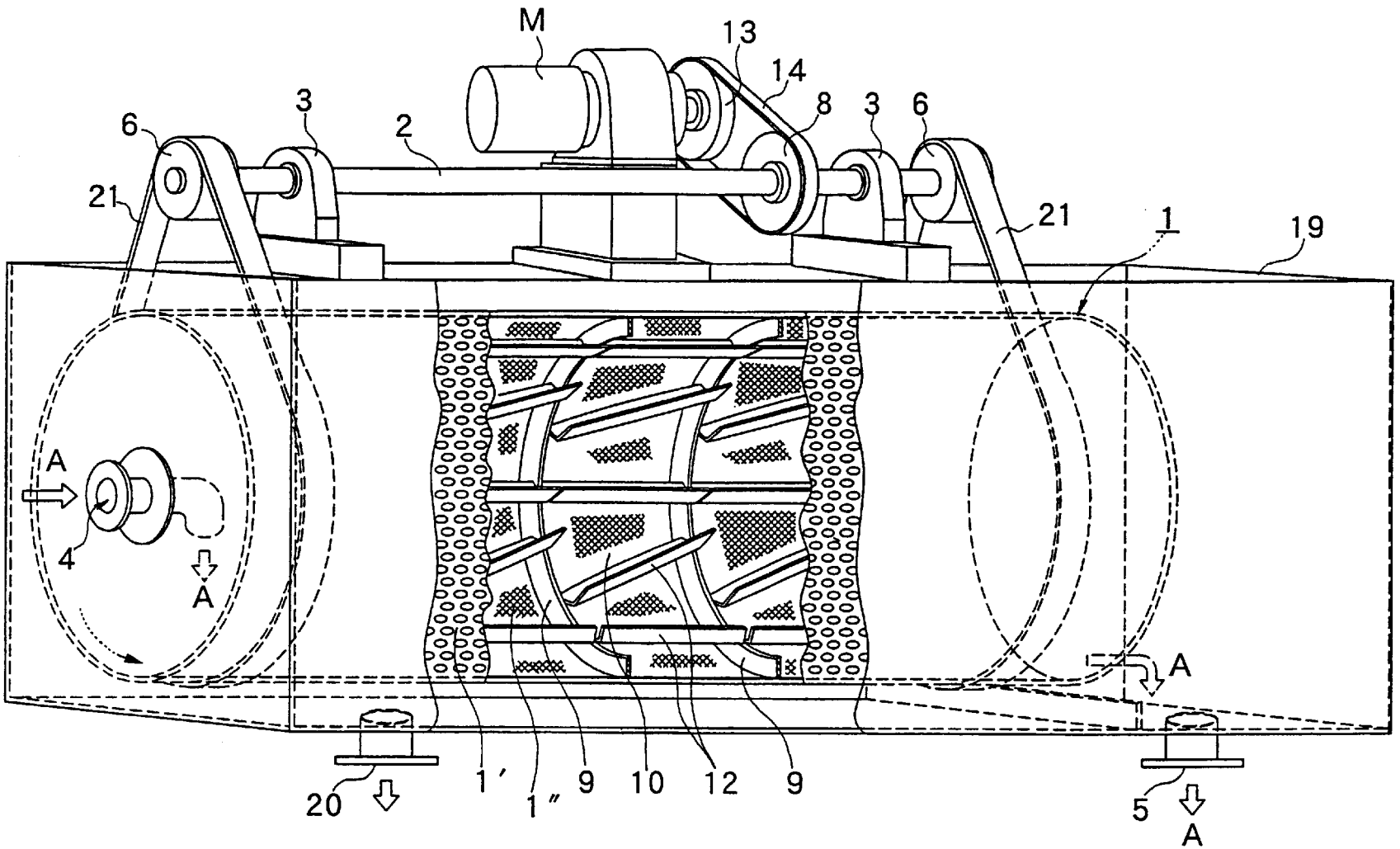
FIG. 1 is a perspective view, partly cut-away, showing one embodiment of a paper stock cleaning apparatus of the present invention.

As shown in FIG. 1 as well as elsewhere, a pair of drum suspension driving belts 21 is disposed over external peripheral surfaces of opposite ends of an air-permeable and water-permeable drum 1 and upper ends of the belts 21 are suspended over a pair of driving wheels 6. By doing so, the drum 1 is rotatably horizontally supported within a vessel 19 in an overhead suspension fashion.

The pair of driving wheels 6 is disposed at opposite ends of a driving shaft 2. The driving shaft 2 is supported on bearings 3. The driving shaft 2 is rotatably fixed to an upper end of the vessel 19 through the bearings 3. Thus, the air-permeable and water-permeable drum 1 is loaded on the vessel 19 by the bearings 3 and horizontally disposed.

A transmission wheel 8 is disposed at a midpoint of an extension of the driving shaft 2 and a transmission belt 14 is disposed between driving wheels 13 provided on a motor M, such that the driving shaft 2 is rotated and the air-permeable and water-permeable drum 1 is rotated. In the drawings, an arrow S indicates a direction of rotation of the air-permeable and water-permeable drum 1.

The air-permeable and water-permeable drum 1 has a paper stock inlet port 4 formed in a central area of one end face thereof and the other end face is open to serve as a paper stock outlet port 5. A paper stock A supplied through the paper stock inlet port 4 is loaded in a first paper stock cleaning zone 10 formed on an internal peripheral surface of an inlet end of the drum 1. The paper stock A loaded in this drum 1 flows toward the paper stock outlet port 5. During this time, substitution cleaning liquid (filtrate) is discharged through an air-permeable and water-permeable drum peripheral wall.

Figure 2:
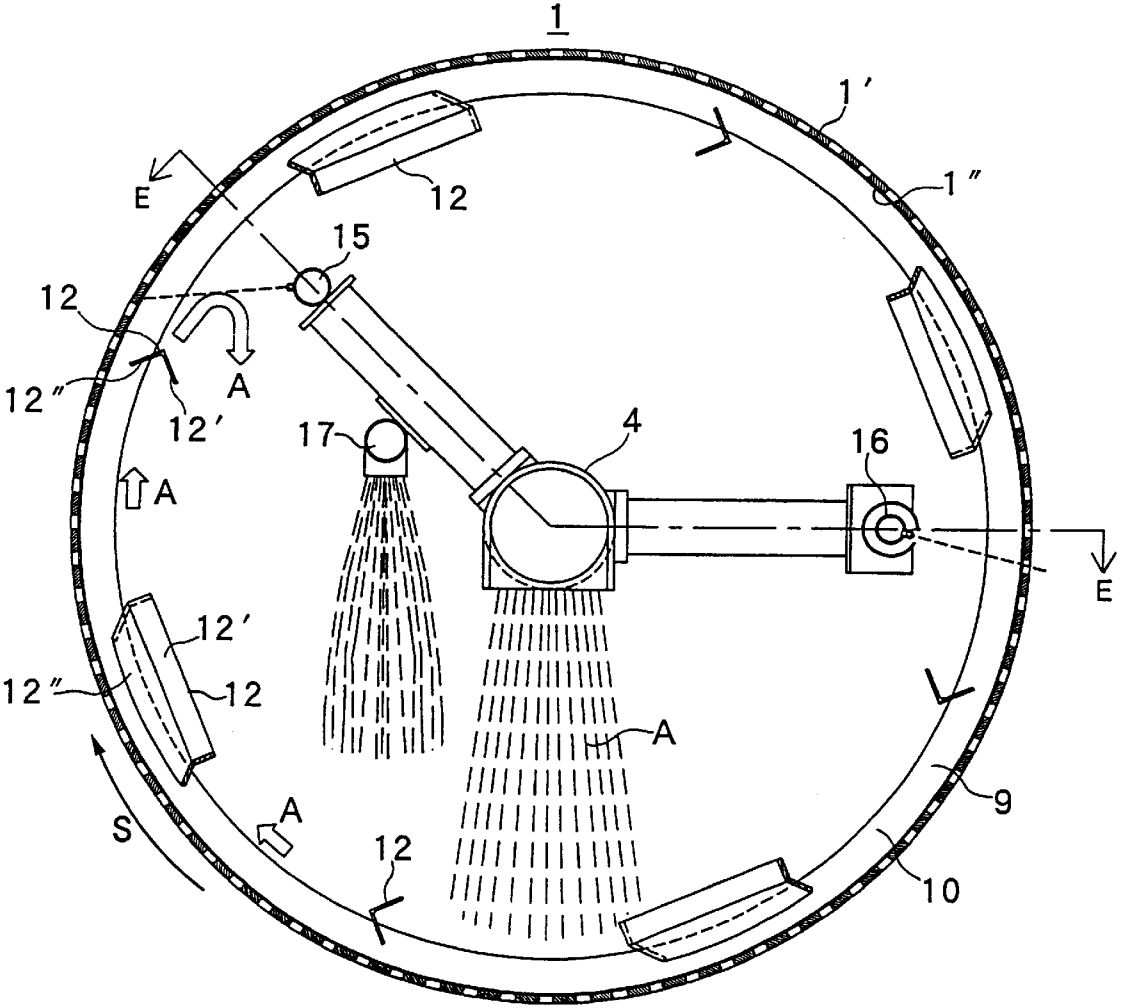
FIG. 2 is a cross sectional view taken in a direction perpendicular to an axis of an air-permeable and water-permeable drum of the above apparatus.
Figure 3:
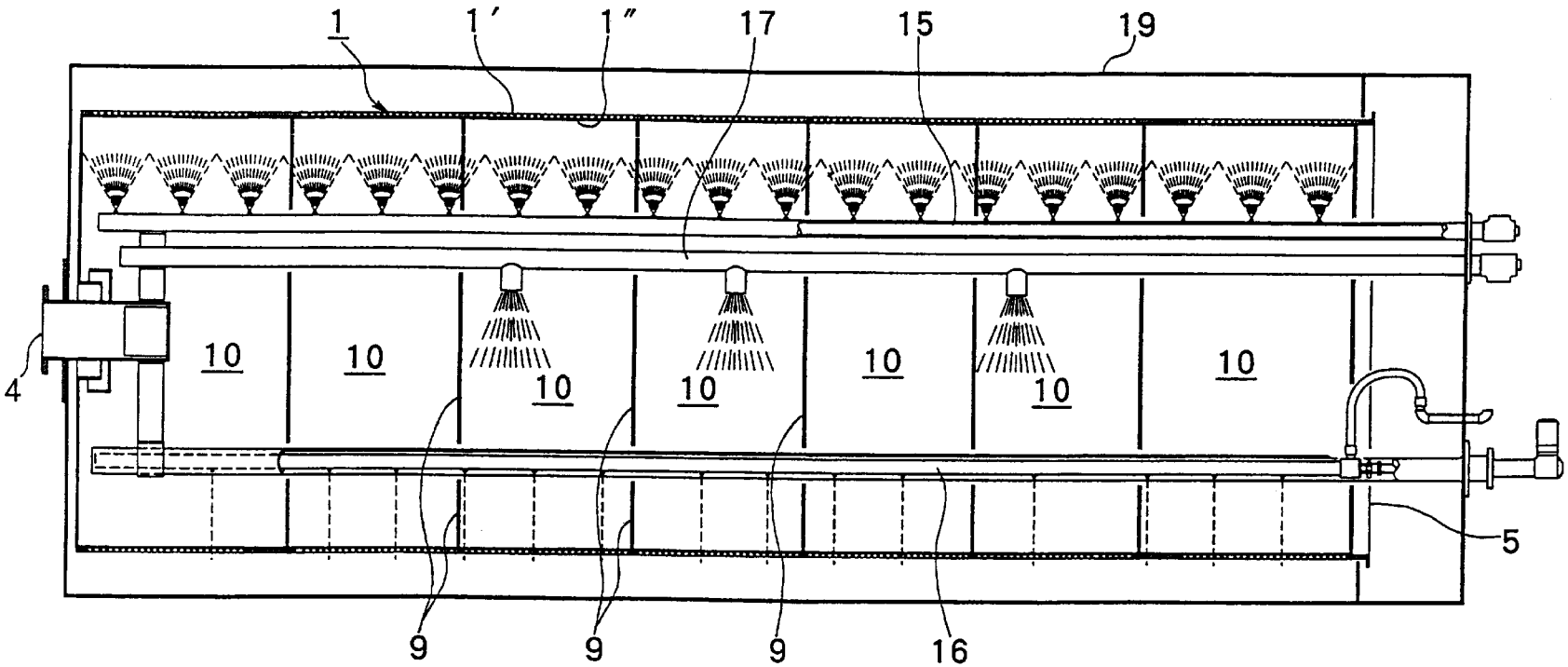
FIG. 3 is a vertical sectional view taken in a direction of the axis of the air-permeable and water-permeable drum of the above apparatus and shows piping but omits a raking plate.

As shown in FIGS. 2 and 3, within the air-permeable and water-permeable drum 1, a paper stock cleaning water supply pipe 17 is horizontally disposed on an axis of the drum 1, and a paper stock raking shower pipe 15 is axially horizontally disposed towards an internal surface in a paper stock raking-up direction, so that the paper stock A adhered to the internal peripheral surface of the drum 1 raked up by raking plates 12 is washed away downward to thereby enhance the falling effect.

Moreover, a high pressure cleaning shower pipe 16 is horizontally disposed towards the internal surface in the axial direction of the drum, and air and water holes of the air-permeable and water-permeable drum 1 are cleaned with the high pressure water coming through the shower pipe 16, so that filtration and dehydration are fully satisfactorily performed.

As shown in FIG. 3, the raking shower pipe 15, the high pressure cleaning shower pipe 16, and the cleaning water supply pipe 17 are supported on an internal end of the pipe forming the paper stock inlet port 4 which projects inward of the drum 1 through a bracket, while the other ends thereof are supported on a side plate of the vessel 19 confronting the paper stock outlet port 5.

As means for forming the air-permeable and water-permeable drum 1 into an air-permeable and water-permeable structure, an external barrel 1' is composed of a punched metal plate with a plurality of air-permeable and water-permeable holes formed therein, and a mesh made of metal is internally lined on an internal peripheral surface of the external barrel 1', thereby forming an internally-lined mesh barrel 1". Then, the internally-lined mesh barrel 1" and the external barrel 1' composed of a punched metal plate are integrally formed into a composite barrel structure. The filtrate is discharged outside via the internally-lined mesh barrel 1" and via the external barrel 1'.

Annular baffle plates 9 extending in a peripheral direction along the internal peripheral surface of the air-permeable and water-permeable drum 1, i.e., along the internal peripheral surface of the internally-lined mesh barrel 1" are spacedly arranged in the axial direction. The baffle plates 9 are integral with the internally-lined mesh barrel 1" and divide the annular space along the internal peripheral surface of the drum 1 in the axial direction, such that a plurality of paper stock cleaning zones 10 are formed in parallel in the axial direction between the baffle plates 9.

As shown in FIG. 2, the paper stock A, as indicated by an arrow A, supplied into the paper stock inlet port 4, is retained between the baffle plates under the baffling effect of the baffle plates 9 and moves, zone by zone, through the respective cleaning zones 10 (moves, zone by zone, over the respective baffle plates 9) in accordance with rotation of the air-permeable and water-permeable drum 1 and reaches the paper stock outlet port 5.

The baffle plates 9 may be partly disconnected at the midpoint of their extension in the peripheral direction or otherwise a paper stock flow-through port may be formed in their side surfaces.

As shown in FIGS. 4 to 7, the raking plates 12 extending in a direction intersecting the baffle plates 9 are spacedly arranged in the peripheral direction of the drum 1. The raking plates 12 between adjacent baffle plates 9 are, as shown in FIGS. 4 to 7, arranged in a zigzag manner.

Figure 5:
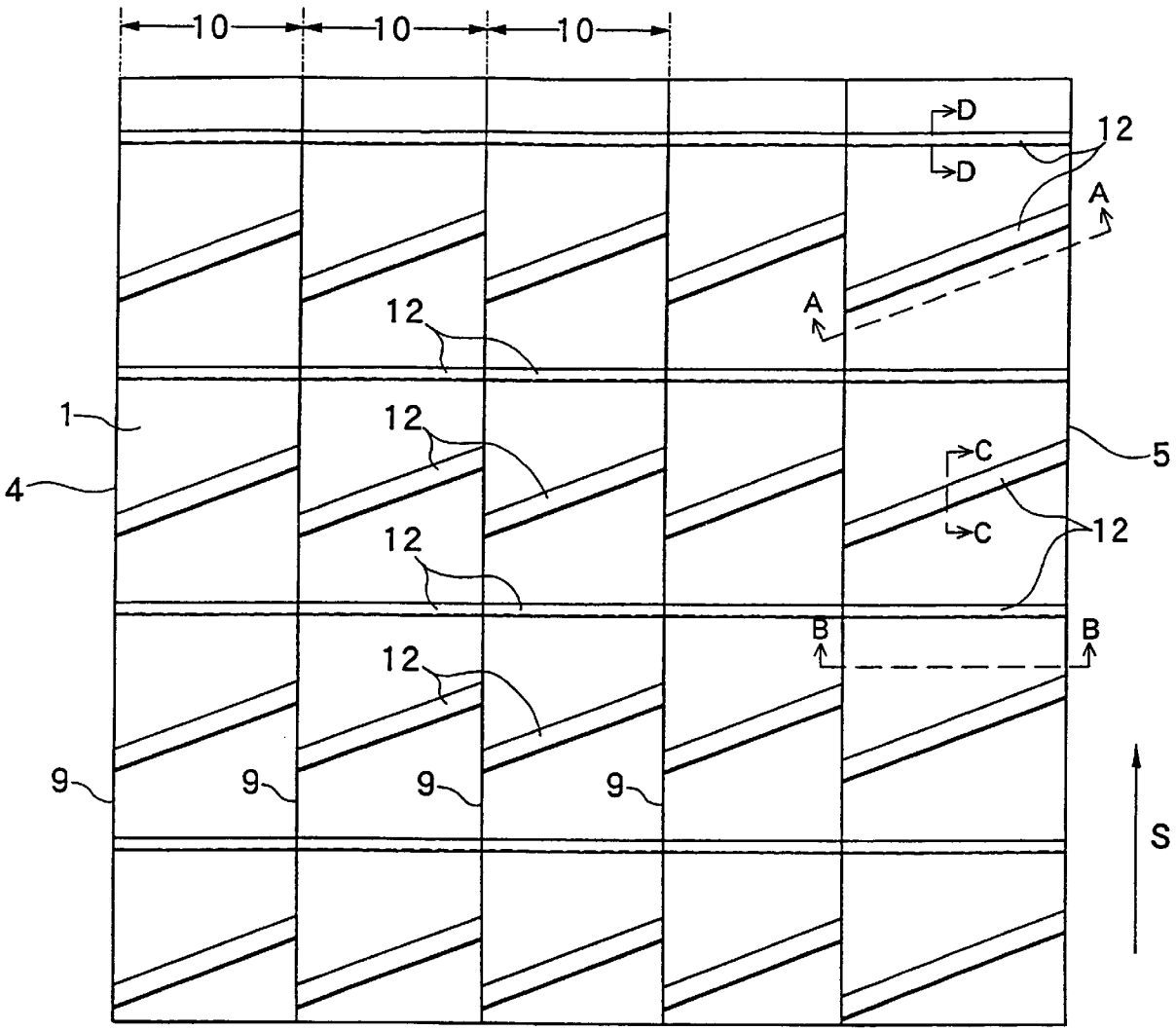
FIG. 5 is a development view of the air-permeable and water-permeable drum, showing another arrangement example of the raking plate.

As shown in FIGS. 1 and 5, between the raking plates 12 arranged in a zigzag manner, the raking plates 12 extending in the axial direction of the drum 1 are arranged in a row and such arranged raking plates 12 are spacedly arranged in the peripheral direction of the drum 1. That is to say, the raking plates 12 arranged in a zigzag manner and the raking plates 12 linearly arranged are used in combination.

Figure 4:
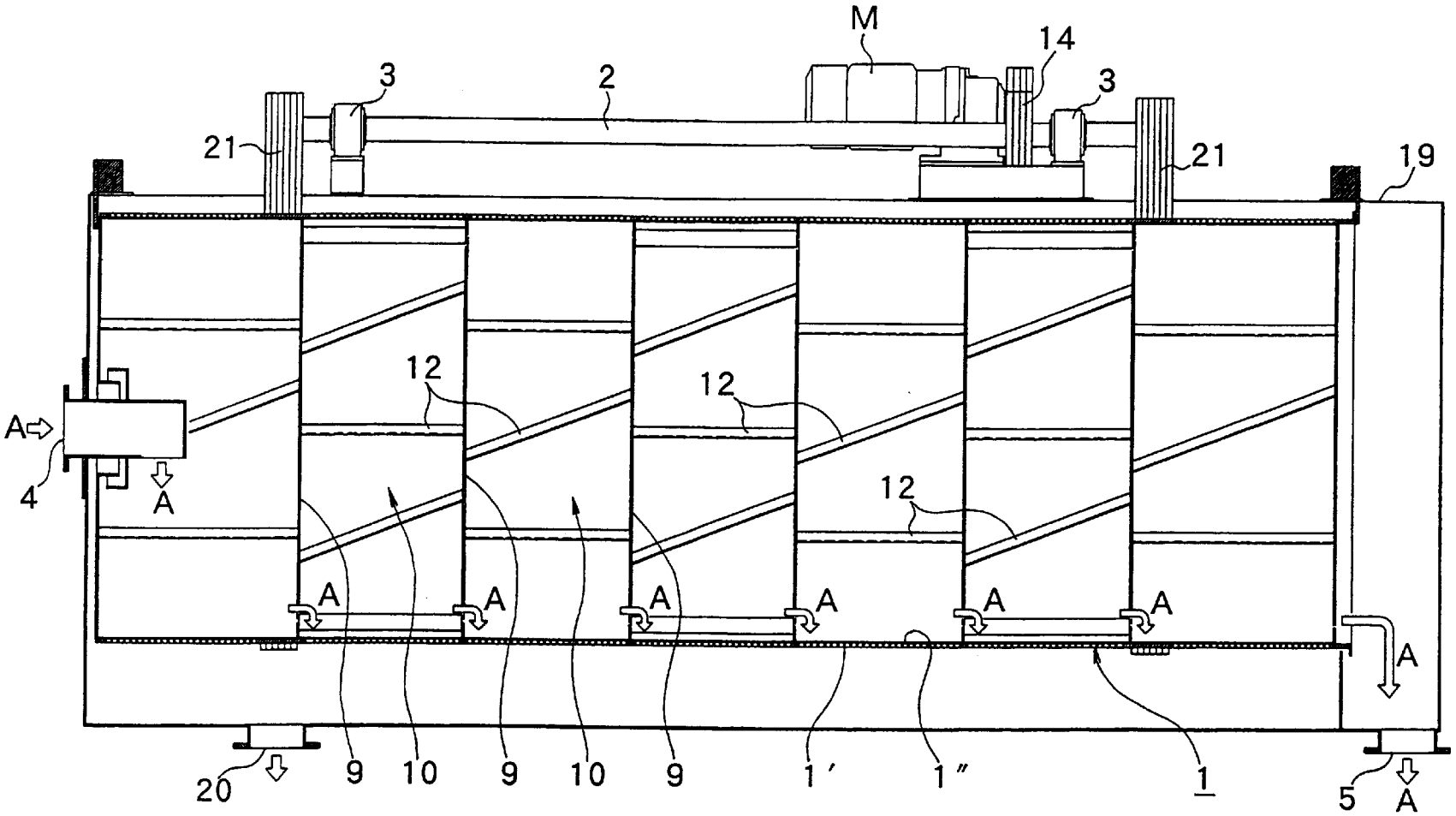
FIG. 4 is a vertical sectional view taken in a direction of the axis of the air-permeable and water-permeable drum of the above apparatus and shows an arrangement of the raking plate.
Figure 6:
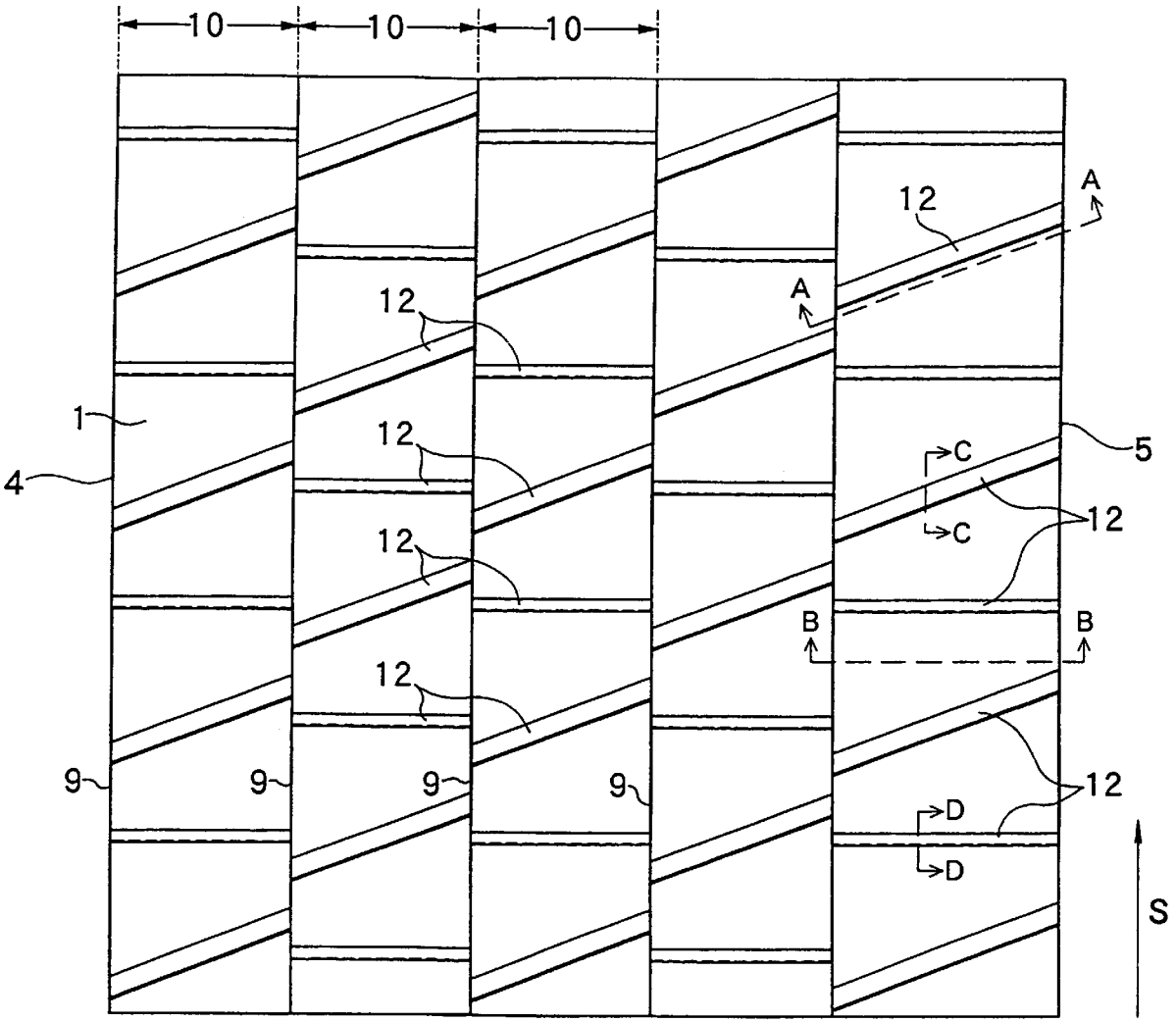
FIG. 6 is a development view of the air-permeable and water-permeable drum, showing a further arrangement example of the raking plate.

Opposite ends of each raking plate 12 are connected to its adjacent baffle plates 9 by soldering or the like. As shown in FIGS. 4 and 6, some of the raking plates 12 are oriented in the axial direction intersecting at right angles with the baffle plates 9, and others are oriented in a direction slantwise intersecting the axial line.

Figure 7:
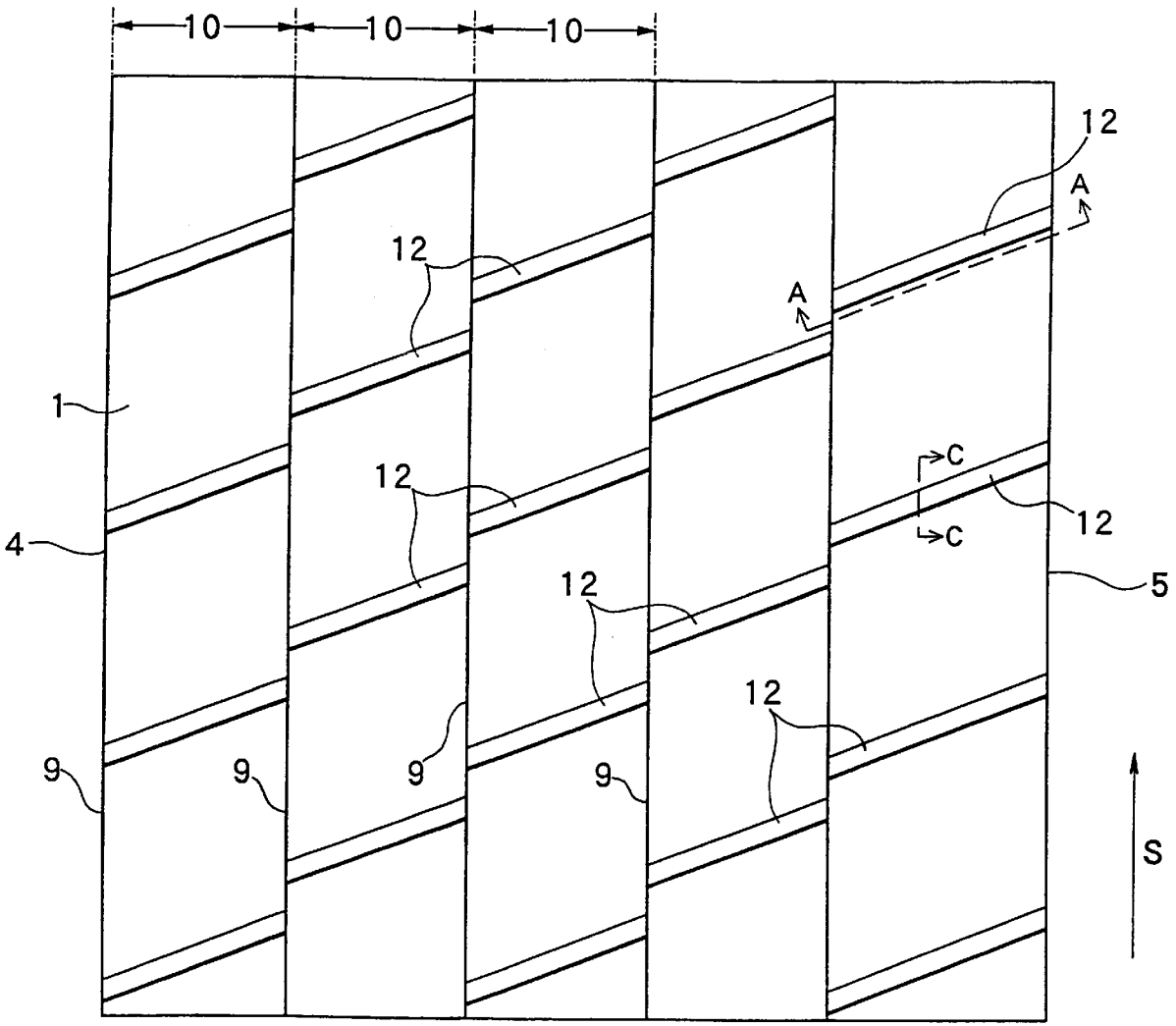
FIG. 7 is a development view of the air-permeable and water-permeable drum, showing a still further arrangement example of the raking plate.

As shown in FIG. 7, all of the raking plates 12 are oriented slantwise with respect to the baffle plates 9 and the axial line.

More specifically, all or a part of the raking plates 12 in the respective paper stock cleaning zones 10 are disposed slantwise with respect to the axial line and all or a part of the raking plates 12 are allowed to project from the internal edges of the baffle plates 9. That is to say, the external edge parts (external peripheral surface side of the drum 1) extend between the adjacent baffle plates 9 and the internal edge parts (axial line side of the drum 1) project inwardly from between the adjacent baffle plates 9.

The overall raking plates 12 are arranged in such a manner as to project inward from between the baffle plates 9. That is to say, the raking plates 12 project inward from the internal edge parts of the baffle plates 9.

Figure 11:
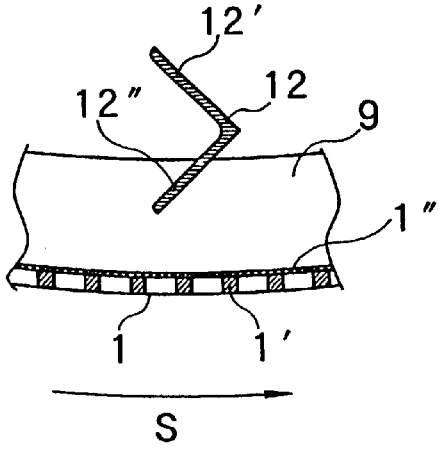
FIG. 11 is a sectional view taken on line D—D of FIGS. 5, 6 and 7.

As shown in FIG. 11, as well as elsewhere, a protrusion 12' of the raking plate 12 is inclined so as to form a relief angle with respect to a direction of rotation of the air-permeable and water-permeable drum 1. Likewise, the internal edge part 12" of the raking plate 12 extending between the baffle plates 9 is also inclined to form a relief angle with respect to the direction of rotation of the drum 1.

That is to say, the internal edge part 12" and the protrusion 12' of the raking plate 12 are inclined in a direction for enhancing the falling and back-flow of the paper stock A when the paper stock A is raked up in accordance with rotation of the drum 1.

The inclined raking plate 12 is oriented with a downward gradient towards the paper stock outlet port 5. In other words, the paper stock raking plate 12 is oriented with an upward gradient towards the paper stock inlet port 4.

By orienting the inclined raking plate 12 with a downward gradient towards the paper stock outlet port 5, a part of the paper stock A raked up by the inclined raking plate 12 can be cleaned in an appropriate manner while actively inviting the flow of the paper stock cleaning zone adjacent to the paper stock outlet port 4 and preventing an occurrence of convection in each zone.

Figure 8:
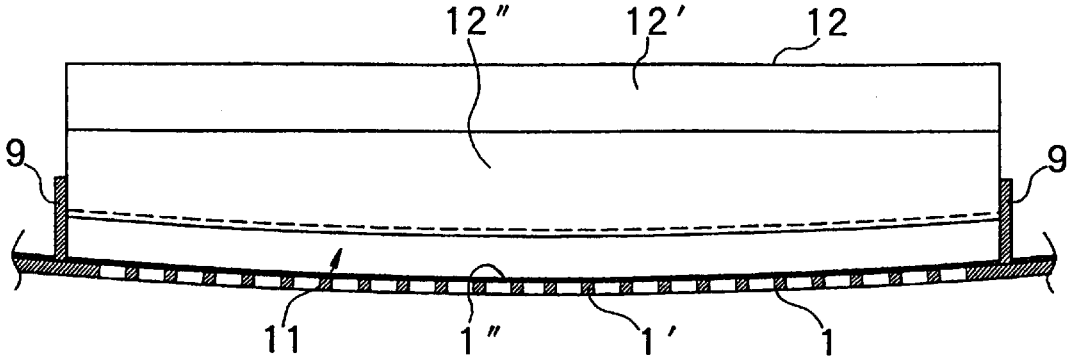
FIG. 8 is a sectional view taken on line A—A of FIGS. 5, 6 and 7.
Figure 9:
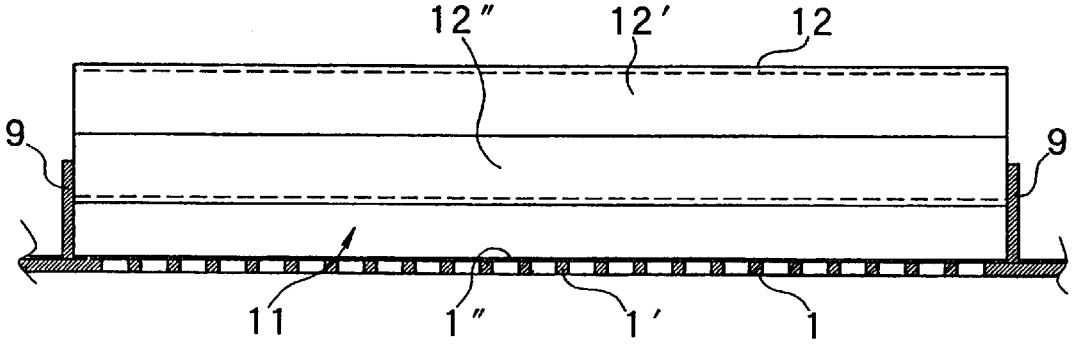
FIG. 9 is a sectional view taken on line B—B of FIGS. 5, 6 and 7.
Figure 10:
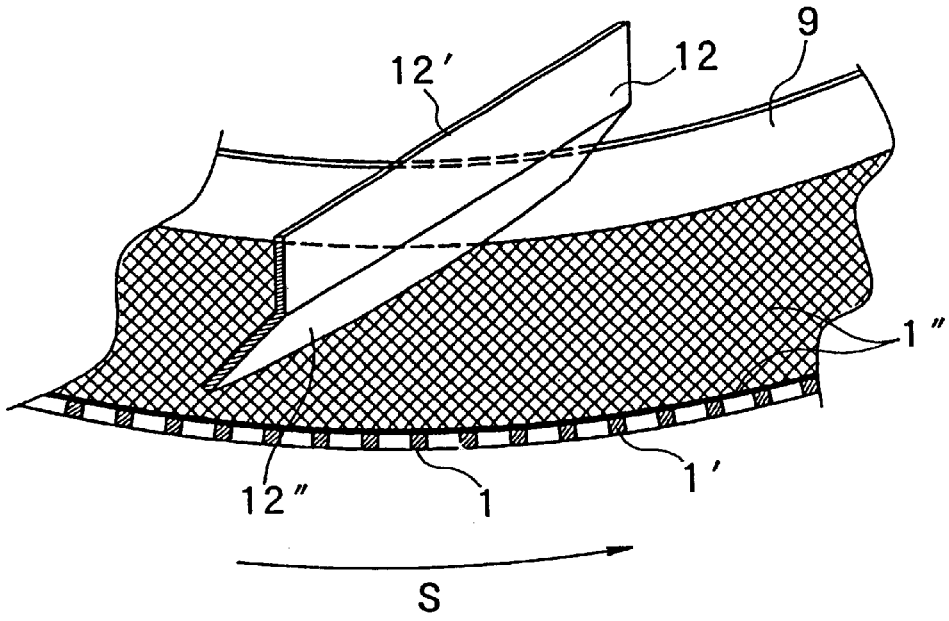
FIG. 10 is a perspective sectional view taken on line C—C of FIGS. 5, 6 and 7.

As shown in FIGS. 8 and 9, a paper stock flow-through space 11 for allowing the paper stock A to flow therethrough in the peripheral direction is formed between the external edge of the inclined raking plate 12 and an internal peripheral surface of the air-permeable and water-permeable drum 1, and the external edge of the inclined raking plate 12 is formed in a curved plane generally in harmony with that of the internal peripheral surface of the air-permeable and water-permeable drum 1 (internal peripheral surface of the internally-lined mesh barrel 1") such that a space 11 between a lower edge of the inclined raking plate 12 and a curved plane of the internal peripheral surface of the air-permeable and water-permeable drum 1 is generally uniform over the entire length of the raking plate 12. By doing so, the back-flow of the paper stock A is uniformly performed through the space 11.

The paper stock A supplied into the drum 1 through the paper stock inlet port 4 is, as previously described, restrained in flow by the baffle plates 9 and caused to flow with the cleaning water through the cleaning water supply pipe 17 in the respective paper cleaning zones 10, moves, zone by zone, through the paper stock cleaning zones 10 and overflows to the outlet port 5. During this time, as shown in FIG. 2, in the respective paper stock cleaning zones 10, the paper stock A is raked up in the peripheral direction from the internal bottom part of the drum 1 by the internal edge parts 12" extending between the baffle plates 9 (in the paper stock cleaning zones) of the raking plates 12 and the protrusions 12' protruding from between the baffle plates 9 and caused to fall and back-flow until it reaches the nearby area of each dead point on the drum side. This procedure is repeated in the respective paper stock cleaning zones 10.

The raking plates 12 knead the paper stock A with the cleaning water while fully satisfactorily agitating and dispersing the paper stock A, and the substitution water is discharged, as a filtrate, into the vessel 19 through the peripheral wall of an air-permeable and water-permeable structure of the drum 1 for each paper stock cleaning zone 10. The filtrate in the vessel 9 is guided outside through a filtrate outlet port 20 formed in a bottom plate of the vessel 9.

In this way, a cleanly washed paper stock can be obtained in the cleaning zone of the final stage. The cleanly washed paper stock thus obtained is discharged downward of the drum while being overflowed to the paper stock outlet port 5. This good quality of cleanly washed paper stock is supplied as a paper making material.

As another example of the cleaning zones 10, at least one cleaning zone of the final stage may be simply divided by the baffle plate(s) 9 without being provided with the raking plate 12.

The horizontally disposed drum may be perfectly horizontal or it may be slightly inclined with a downward gradient at its paper stock outlet port side.

According to the present invention, the paper stock loaded through one end of the air-permeable and water-permeable drum is raked up in the peripheral direction by the raking plates and falls, repeatedly, in the paper stock cleaning zones formed between the baffle plates and is finally brought to the paper stock outlet port from the paper stock inlet port by moving, zone by zone, through the paper stock cleaning zones. During the above-mentioned procedure, satisfactory agitation and dispersion of the paper stock are enhanced and filtrate is discharged through a peripheral wall of the drum for the paper stock zone(s) of each stage divided by the baffle plates, and effective substitution cleaning is carried out. A cleanly washed paper stock can be obtained in the paper stock cleaning zone of the final stage and discharged. The paper stock cleaning zones and the raking plates provided in the respective cleaning zones can be synergistically increased in function and the effect of cleaning of the paper stock can be enhanced significantly.

Obviously, numerous changes and modifications of the present invention are possible in light of the above teachings. It is, therefore, to be understood that within the scope of the appended claims, the invention may be practiced otherwise than as specifically described herein.

What is claimed is:

1. A paper stock cleaning apparatus comprising: a rotatably horizontally disposed air-permeable and water-permeable drum, one end of which is provided with a paper stock inlet port for intake of paper stock into said air-permeable and water-permeable drum, and the other end of which is provided with a paper stock outlet port, said air-permeable and water-permeable drum having an internal peripheral surface and being rotatable about an axis extending in an axial direction; a cleaning water supply device for supplying cleaning water into said air-permeable and water-permeable drum; a plurality of baffle plates extending in a peripheral direction of said air-permeable and water-permeable drum about said axis so as-to project inwardly from said internal peripheral surface of said air-permeable and water-permeable drum and so as to be spacedly arranged in said axial direction, said baffle plates having internal edges; a plurality of paper stock cleaning zones divided in the axial direction by said baffle plates and being formed between said baffle plates, and a plurality of raking plates being spacedly arranged in the peripheral direction between adjacent baffle plates and adapted to rake the paper stock in said paper stock cleaning zones in a direction of rotation of said drum, the paper stock loaded through said paper stock inlet port being allowed to move, zone by zone, through said paper stock cleaning zones formed between said baffle plates and brought to said paper stock outlet port, the paper stock, when in said paper stock cleaning zones between said baffle plates, being raked up in the peripheral direction by said raking plates in accordance with rotation of said air-permeable and water-permeable drum and falling by force of gravity, repeatedly; wherein all or a part of said raking plates in said paper stock cleaning zones are disposed in inclined postures with respect to said axis; and wherein all or a part of said raking plates include portions that project inwardly beyond said internal edges of said baffle plates.

2. A paper stock cleaning apparatus according to claim 1, wherein portions of said raking plates that project inwardly beyond said internal edges of said baffle plates are inclined so as to form a relief angle with respect to a direction of rotation of said air-permeable and water-permeable drum.

3. A paper stock cleaning apparatus according to claim 2, wherein a paper stock flow-through space for allowing the paper stock to flow therethrough in the peripheral direction is formed between an external edge of said raking plates and said internal peripheral surface of said air-permeable and water-permeable drum, and an external edge of each of said raking plates is formed in a curved plane generally complementary with that of the internal peripheral surface of said air-permeable and water-permeable drum.

4. A paper stock cleaning apparatus according to claim 1, wherein said raking plates are oriented with a downward gradient towards said paper stock outlet port.

5. A paper stock cleaning apparatus according to claim 4, wherein a paper stock flow-through space for allowing the paper stock to flow therethrough in the peripheral direction is formed between an external edge of said raking plates and said internal peripheral surface of said air-permeable and water-permeable drum, and an external edge of each of said raking plates is formed in a curved plane generally complementary with that of the internal peripheral surface of said air-permeable and water-permeable drum.

6. A paper stock cleaning apparatus according to claim 1, wherein a paper stock flow-through space for allowing the paper stock to flow therethrough in the peripheral direction is formed between an external edge of said raking plates and said internal peripheral surface of said air-permeable and water-permeable drum, and an external edge of each of said raking plates is formed in a curved plane generally complementary with that of the internal peripheral surface of said air-permeable and water-permeable drum.

* * * * *